US007110706B1

(12) United States Patent
Barnes et al.

(10) Patent No.: US 7,110,706 B1
(45) Date of Patent: Sep. 19, 2006

(54) TONER REPLENISHER AND METHOD FOR AN ELECTROGRAPHIC IMAGING MACHINE

(75) Inventors: Gerald Francis Barnes, Farmington, NY (US); Paul Essic Thompson, Webster, NY (US); Edward M. Eck, Lima, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/802,375

(22) Filed: Mar. 17, 2004

Related U.S. Application Data

(60) Provisional application No. 60/462,003, filed on Apr. 11, 2003.

(51) Int. Cl.
*G03G 15/08* (2006.01)

(52) U.S. Cl. ..... 399/258; 399/254; 399/120

(58) Field of Classification Search ..... 399/254, 399/258, 260, 263; 299/258, 254, 120
See application file for complete search history.

(56) References Cited

U.S. PATENT DOCUMENTS 4,304,273 A * 12/1981 Caudill et al. ..... 141/268
4,439,034 A * 3/1984 Daniels ..... 399/257
4,452,174 A * 6/1984 Fedder ..... 399/62
5,229,823 A * 7/1993 Kalyandurg et al. ..... 399/254
6,125,243 A * 9/2000 Shoji et al. ..... 399/29
6,466,749 B1 * 10/2002 O'Brien ..... 399/27
6,526,247 B1 2/2003 Stelter et al.
6,647,235 B1 * 11/2003 Patterson et al. ..... 399/254
6,785,496 B1 * 8/2004 Iwata et al. ..... 399/258
6,839,533 B1 * 1/2005 Ban et al. ..... 399/260
2002/0071692 A1 6/2002 Thompson et al.
2003/0002890 A1 1/2003 Patterson et al.

* cited by examiner

*Primary Examiner*—Yaritza Guadalupe-McCall
(74) *Attorney, Agent, or Firm*—Donna Suchy

(57) ABSTRACT

The invention relates to a toner replenisher and method for an electrographic imaging machine, including flow of toner through a toner replenisher and sealing between a toner replenisher and a toner bottle. According to the numerous aspects of the invention, a toner replenisher and method for an electrographic imaging machine are provided, including improved flow of toner through a toner replenisher and/or improved sealing between a toner replenisher and a toner bottle.

15 Claims, 8 Drawing Sheets

TONER REPLENISHER AND METHOD FOR AN ELECTROGRAPHIC IMAGING MACHINE

RELATED APPLICATIONS

This application claims the benefit of U.S. Provisional Patent Application Ser. No. 60/462,003 filed Apr. 11, 2003.

BACKGROUND

The invention relates to a toner replenisher and method for an electrographic imaging machine, including flow of toner through a toner replenisher and sealing between a toner replenisher and a toner bottle.

In a typical electrographic imaging machine (e.g. copier, duplicator, printer, etc.), for example an electrophotographic imaging machine, a continuous loop of photoconductor film may be used to transfer an image from an input section onto a receiving medium (e.g. a sheet of paper or the like). The film is charged and passed through an input section where an image (i.e. analog or digital) is projected onto the charged film. The film then moves through a developing section where toner (i.e. dry ink) is applied to the charged image before the image is transferred to the sheet of paper. The paper is subsequently passed through a fuser section where the toner is fixed to the paper by passing the paper between a pressure roller and a heated roller.

Before applying the toner to the charged image, many electrophotograpic machines mix the toner with a carrier to form a two-component developer. When using two-component developers, it is necessary to maintain a desired ratio of toner to carrier; this ratio being commonly known as "toner concentration" or "TC". Typically, the TC may range from about 2% to about 14% by mass for general printing applications. However, the actual range of the TC may vary over different ranges depending on the densities and/or relative size of the particular toner and carrier particles being used.

To maintain the proper TC in a particular machine, the toner typically flows from a source (e.g. a bottle or other container) into a mechanism known as a "replenisher" which, in turn, feeds the toner to the developer at a desired rate. Since the charge of toner dictates other process settings within the printing/copying machine, a replenisher that maintains a consistent and controllable flow rate of toner to the developer throughout the printing operation is very desirable. Replenishers are described in U.S. Pat. No. 5,229,823 and U.S. Patent Application Publications U.S. 2002/0071692 A1 and 2003/0002890 A1, the contents of these three publications being fully incorporated by reference as if set forth herein.

Toner has a tendency to bridge in the replenisher. Bridging is a state where the powder becomes a self-supporting mass and resists flow through the replenisher due to the tendency of the particles to support each other or to adhere to each other within the replenisher. This can interrupt toner flow through the replenisher and adversely effect toner concentration.

SUMMARY

According to the numerous aspects of the invention, a toner replenisher and method for an electrographic imaging machine are provided, including improved flow of toner through a toner replenisher and/or improved sealing between a toner replenisher and a toner bottle.

DETAILED DESCRIPTION

Figure 1:
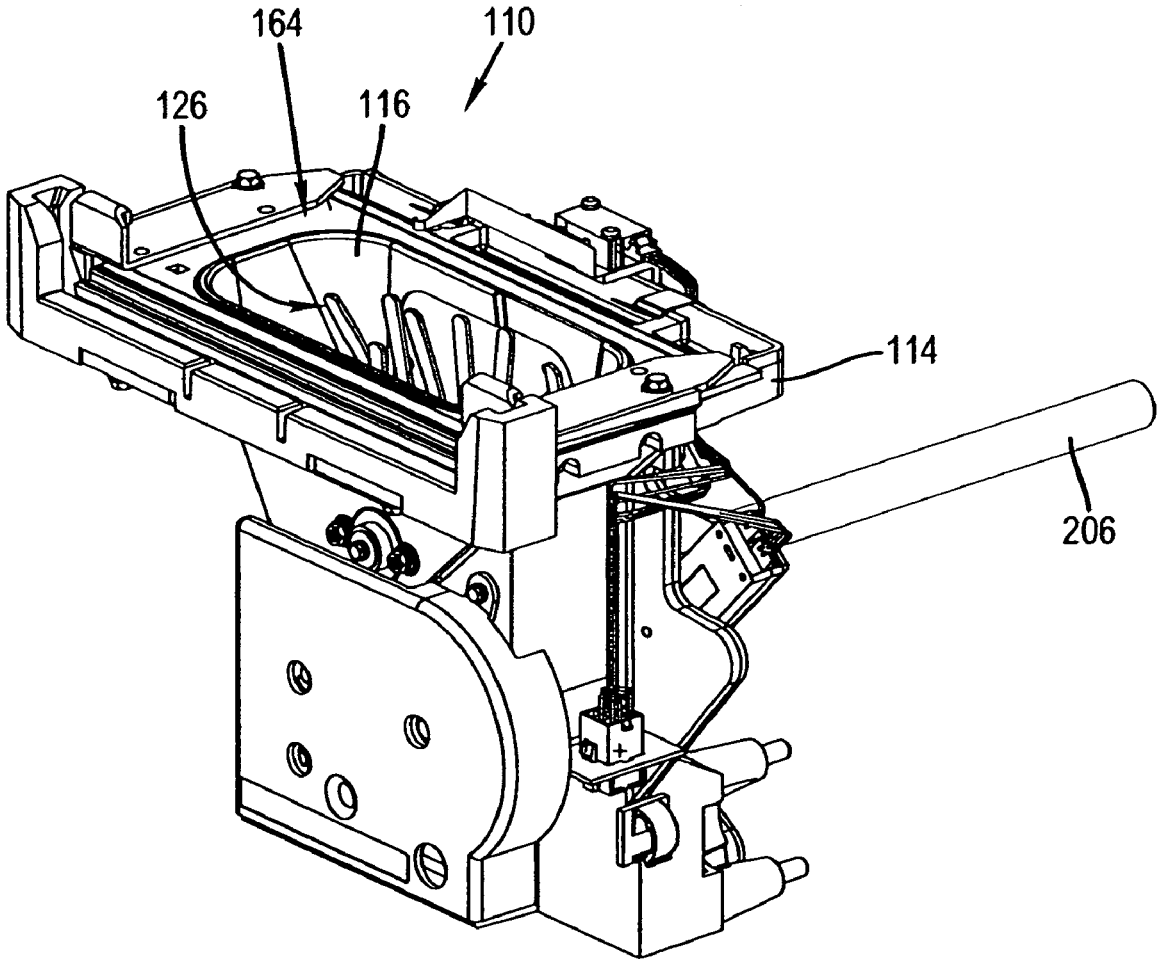
FIG. 1 presents a side perspective view of a toner replenisher according to one aspect of the invention.
Figure 2:
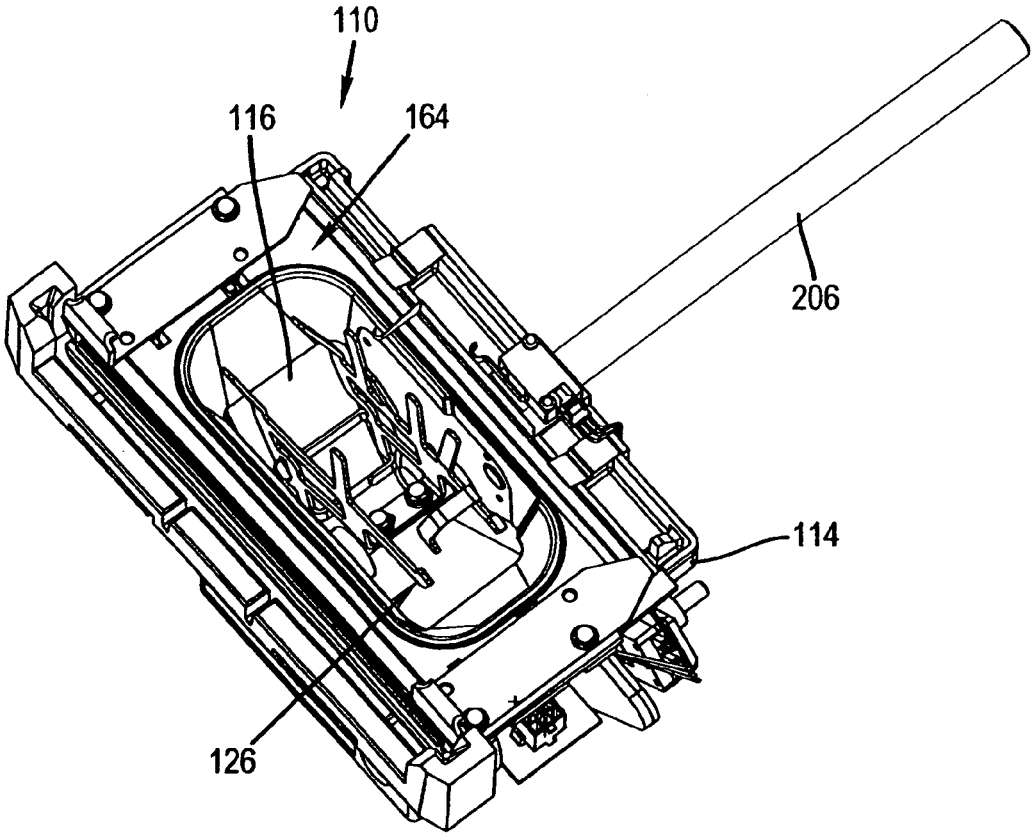
FIG. 2 presents a top perspective view of the FIG. 1 toner replenisher.

Numerous aspects of the invention are presented herein with reference to FIGS. 1–14, which are not drawn to any particular scale, and wherein like components in the numerous views are numbered alike. Although described with reference to specific embodiments presented in the drawings, it is not intended to so limit the invention, the true breadth and scope of the invention being defined by the claims appended hereto. Referring now to FIGS. 1–3 and 14, a toner replenisher 110 for an electrographic imaging machine is presented comprising a replenisher housing 114 that defines a toner passage 116. The toner passage 116 comprises an inlet end 118 and an outlet end 120. An agitator drive shaft 122 is provided extending into the replenisher housing 114. A rocking mechanism 124 is connected to the agitator drive shaft 122. A toner agitator 126 is mounted to the agitator drive shaft 122 within the toner passage 116. The toner agitator 126 comprises a plurality of fingers 128 extending toward the inlet end 118.

The outlet end 120 (actually further down the toner passage 116 than shown in FIG. 3) is connected to a replenisher tube 206 that extends into a blender sump of a developer station of the type shown in U.S. Pat. No. 6,526,247 B2, the contents of which are fully incorporated by reference as if set forth herein. In operation, toner flows through the toner passage 116, an auger (not shown) at the bottom of the toner passage 116 feeds toner into the replenisher tube 206, and the toner subseqently flows into the developer sump in a controlled manner through the replenisher tube 206. The agitator drive shaft 122 may be disposed directly above the auger to enhance flow through the toner passage 116.

Referring now to FIGS. 4–7, the toner agitator 126 may comprise a first agitator body 130 defining at least one of the fingers 128, and a second agitator body 132 defining at least another of the fingers 128. The first agitator body 130 and the second agitator body 132 may be spaced from and opposing each other. An agitator base connecting the first agitator body 130 and the second agitator body 132 may also be provided. According to a further embodiment, the first agitator body 130 may define a plurality of the fingers 128, and the second agitator body 132 may define another plurality of the fingers 128. The toner agitator 126 is preferably metal.

Figure 3:
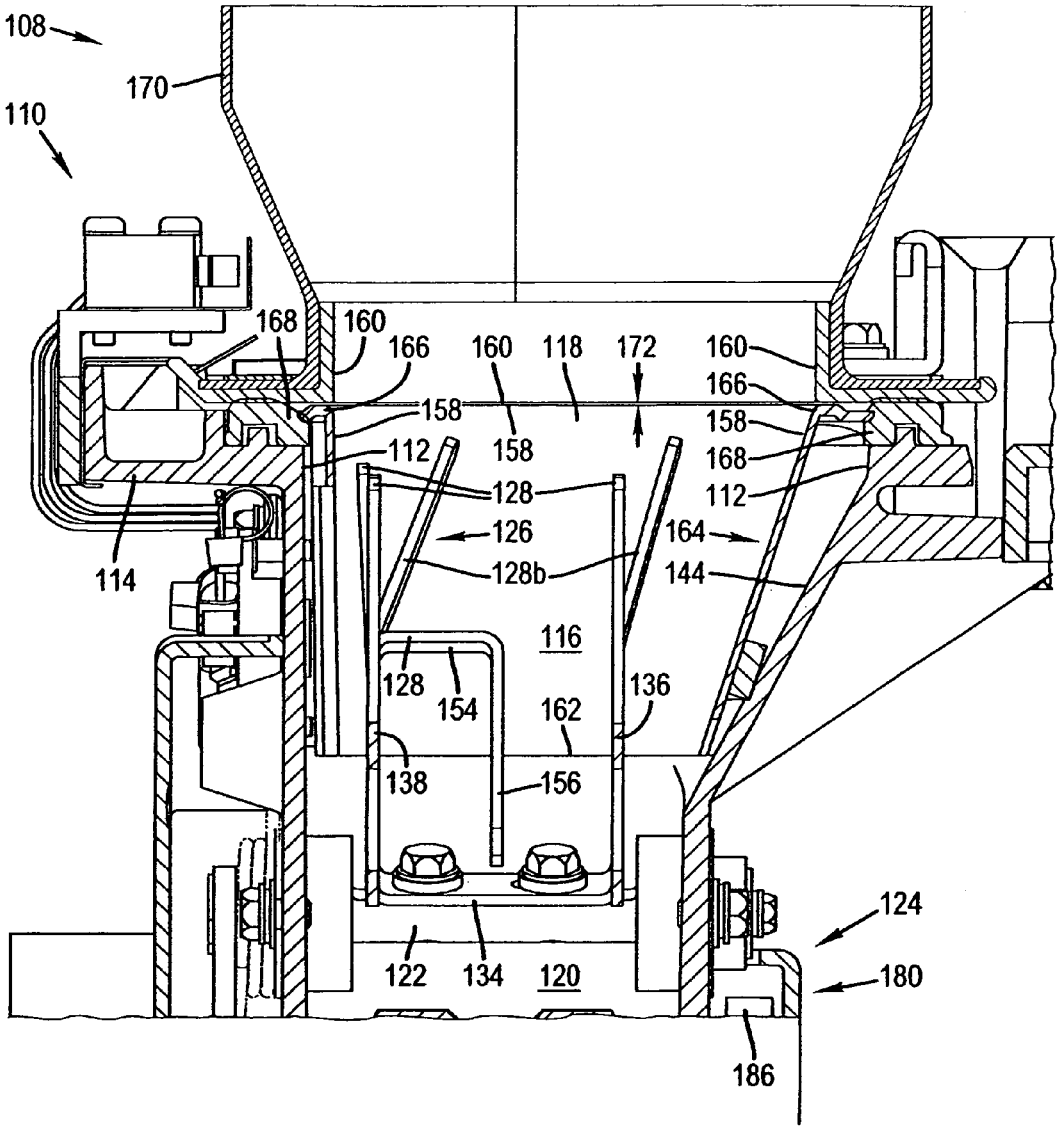
FIG. 3 presents a partial cross-sectional view of the FIG. 1 toner replenisher with a toner bottle installed.
Figure 4:
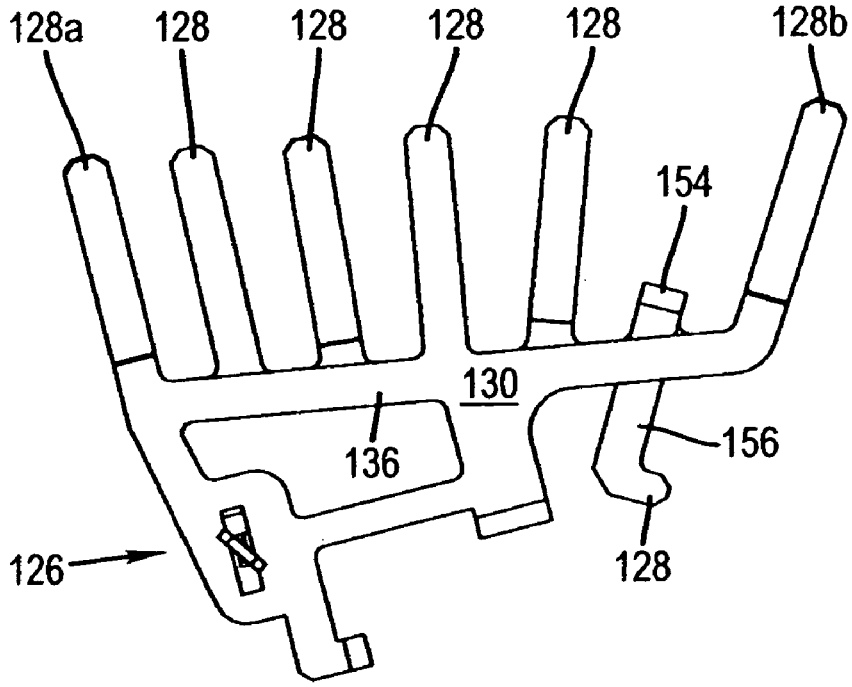
FIG. 4 is a side view of a toner agitator according to one aspect of the invention.
Figure 5:
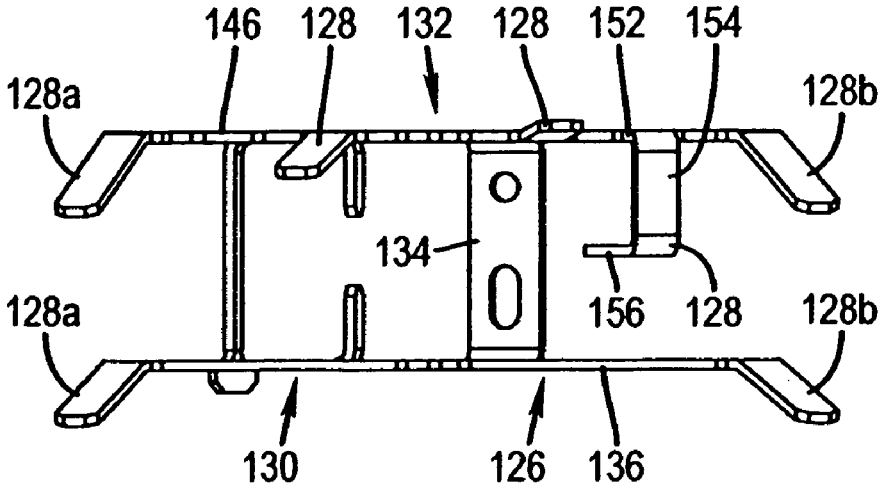
FIG. 5 is a top view of the FIG. 4 toner agitator.
Figure 6:
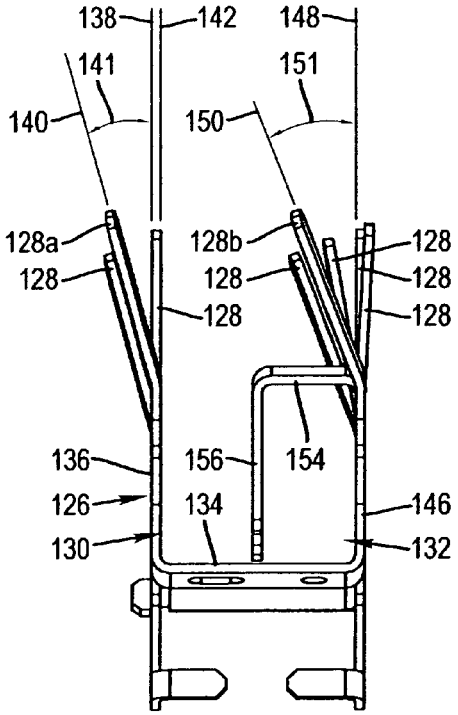
FIG. 6 is a side view of the FIG. 4 toner agitator.

Referring now specifically to FIG. 6, the toner agitator 126 may comprise a first portion 136 that defines a plane 138, at least one of the fingers 128 extending from the first portion 136 and defining an axis 140 at an angle 141 to the plane 138. The toner passage 116 may comprise a sloped wall 144, and the angle 141 may extend one or more of the fingers 128 toward the sloped wall 144, as shown in FIG. 3. Still referring to FIG. 6, another of the fingers 128 may extend from the first portion 136 and define an axis 142 parallel to the plane 138. The toner agitator 126 may further comprise a second portion 146 that defines another plane 148. At least another of the fingers 128 may extend from the second portion 146 and define an axis 150 at an angle 151 to the plane 148.

Figure 7:
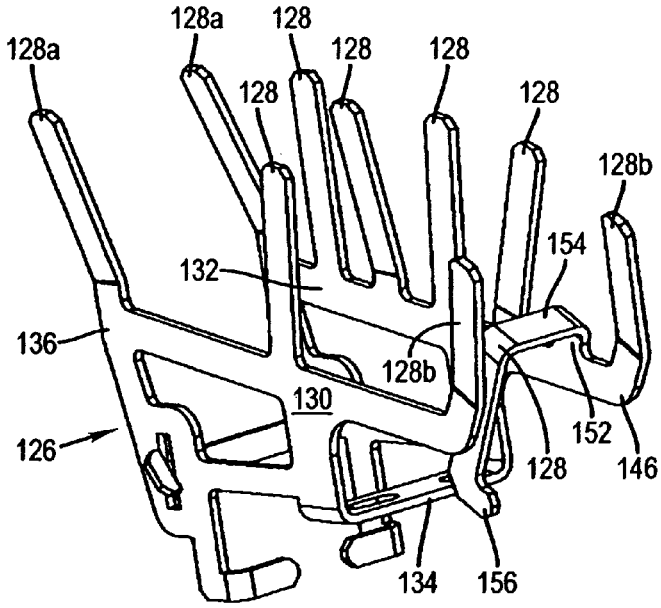
FIG. 7 is a perspective view of the FIG. 4 toner agitator.
Figure 9:
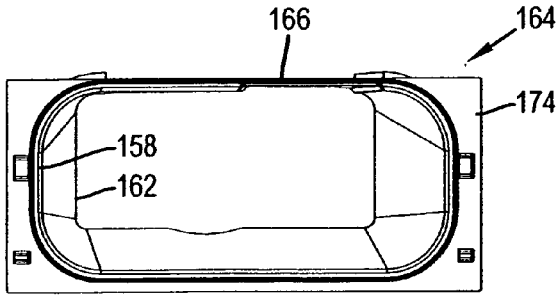
FIG. 9 is a top view of the FIG. 8 funnel.
Figure 8:
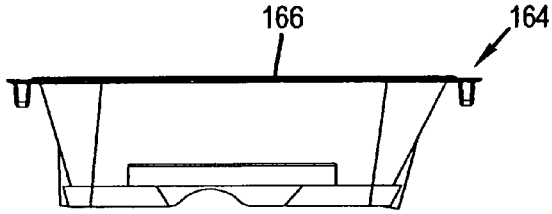
FIG. 8 is a side view of a funnel according to one aspect of the invention.
Figure 10:
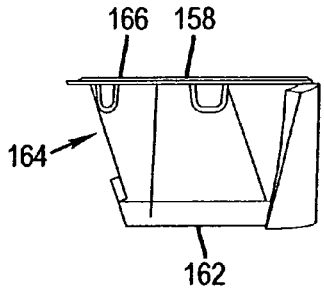
FIG. 10 is a side view of the FIG. 8 funnel.
Figure 11:
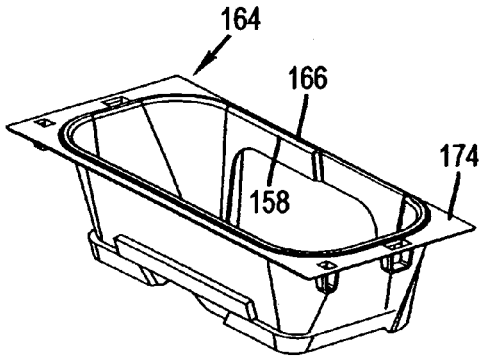
FIG. 11 is a perspective view of the FIG. 8 funnel.
Figure 12:
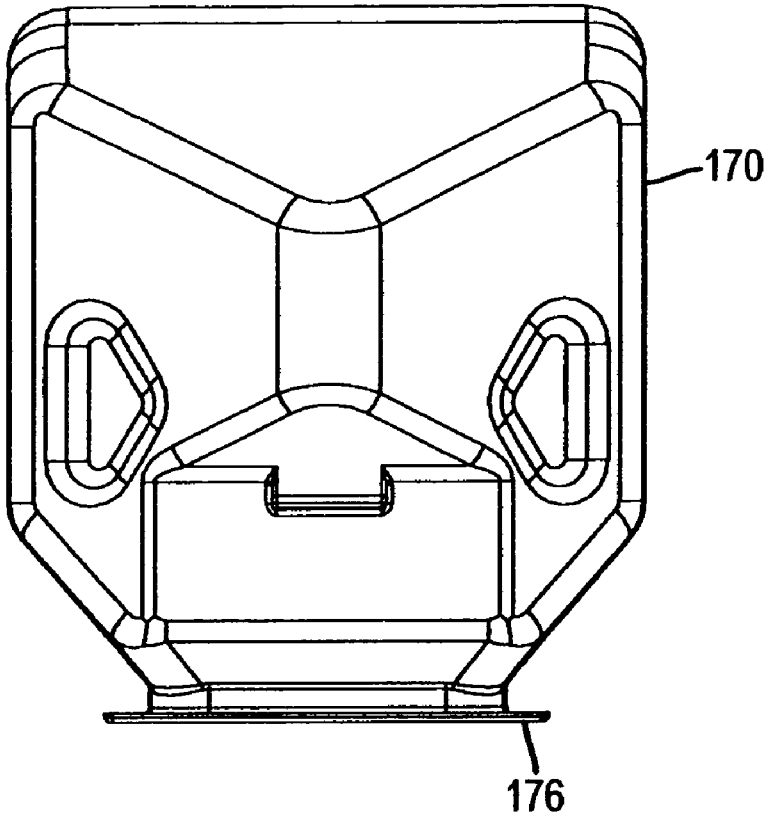
FIG. 12 is a side view of a toner bottle used in conjunction with the various aspects of the present invention.
Figure 13:
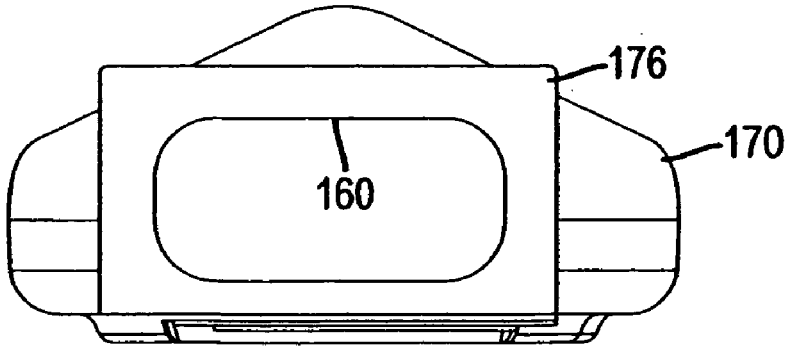
FIG. 13 is a bottom view of the FIG. 12 toner bottle.

Referring now to FIGS. 3 and 7, the toner agitator 126 may further comprise at least one finger 128 having a first finger portion 152 extending toward the outlet end 118, a third finger portion 156 extending toward the inlet end 120, and a second finger portion 154 connecting the first finger portion 152 and the second finger portion 156.

According to a further aspect of the invention, a toner replenisher method is provided for an electrographic imaging machine comprising rocking the toner agitator 126 disposed within the replenisher 114 by rotating the agitator drive shaft 122 extending into the replenisher 114, the replenisher 114 defining the toner passage 116 comprising the inlet end 118 and the outlet end 120, wherein the toner agitator 126 is mounted to the drive shaft, the toner agitator 126 comprising the plurality of fingers 128 extending toward the inlet end 120.

Referring now to FIGS. 3, 8–11 and 13, a funnel 164 according to a further aspect of the invention is presented that may be disposed at the inlet end 118 of the replenisher housing 114. The funnel 164 comprises an inlet mouth 158 that matches a toner bottle mouth 160 and an outlet mouth 162 spaced toward the outlet end 120 and smaller than the inlet mouth 158. The funnel 164 may be a separate piece placed in the inlet end 118. This is particularly desirable if the inlet end 118 defines an inlet end mouth 112 that does not match the toner bottle mouth 160, best shown in FIG. 3. The funnel 164 permits steepening of the sides of the toner passage 116. Ideally, the sides are vertical (no slope), but in practice this is generally not attainable. The inner surface of the funnel 164 that the toner passes over is preferably quite smooth, for example a glossy finish. The funnel material is preferably plastic, but may be made from other suitable materials, including metal and reinforced plastics.

According to a preferred embodiment, outboard fingers 128*a* and 128*b* on opposing ends of the toner agitator 126 extend toward the walls of the funnel 164, and during rocking the extent of their movement places them in close proximity to the walls of the funnel 164, thereby cutting into the toner material and assisting in breaking surface tension and causing flow. If the funnel 164 is not implemented, this concept may be applied to the walls of the toner passage 116 equally well. The fingers 128*a* and 128*b* may come within 0.005 to 0.1 inches of the walls, and may come within 0.040 to 0.060 inches of the walls. One or more outboard fingers 128*a* and 128*b* may extend toward a corner where two walls meet. A curved surface generally joins these two walls, and one or more outboard fingers 128*a* and 128*b* extend toward a corresponding curved surface.

Referring to FIGS. 3, 11, 12 and 13, a replenisher assembly 108 for an electrographic imaging machine is presented, according to a further aspect of the invention, comprising the toner replenisher 110 and a toner bottle 170 defining the toner bottle mouth 160 attached to the inlet end 116, a toner flow restrictor 166 comprising a gap 172 adjacent the toner bottle mouth 160 between the toner bottle 170 and the toner replenisher 110. A seal 168 is provided outside the toner flow restrictor 166 between the toner bottle 170 and the toner replenisher 110. The toner flow restrictor 166 preferably circumscribes the toner bottle mouth 160, and the seal 168 preferably circumscribes the toner flow restrictor 166. The toner flow restrictor 166 may comprise a ridge on a sealing face 174 (FIG. 11) of the toner replenisher 108, and the seal 168 may comprise an elastomeric gasket that may be spaced from the ridge. In one embodiment, the seal 168 is an elastomeric foam material. In this example the gap 172 is defined between the ridge on the funnel 164 and a sealing face 176 of the toner bottle 170. The gap may be on the order of 0.015 inches.

Figure 14:
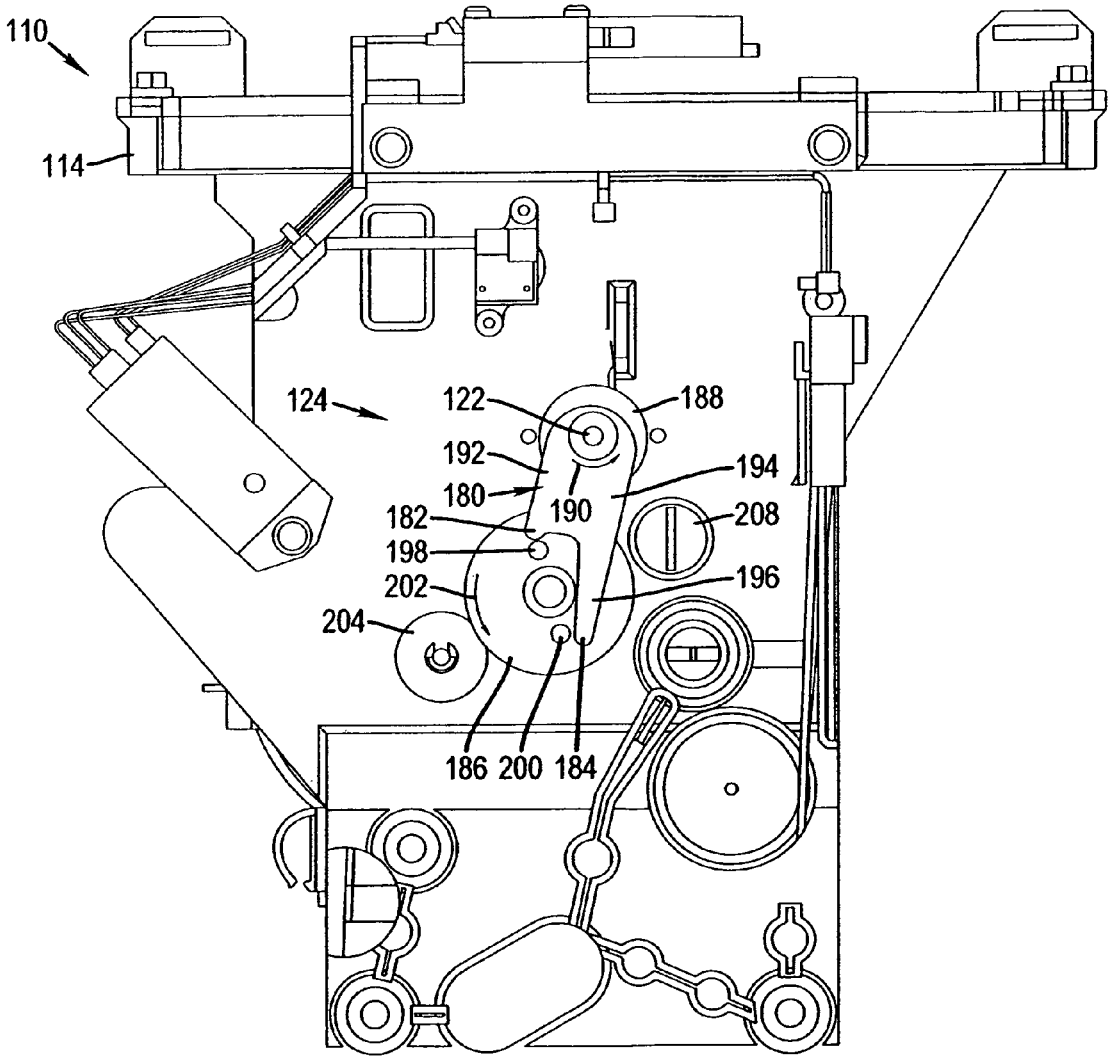
FIG. 14 presents a view of a rocking mechanism according to one further aspect of the invention.

Referring now to FIG. 14, one embodiment of a rocking mechanism 124 is presented. The rocking mechanism 124 comprises an agitator actuator 180 mounted to the agitator drive shaft 122. The agitator actuator 180 has a first actuator cam 182 and a second actuator cam 184. An actuator driver 186 is mounted to the replenisher housing 114, wherein rotating the actuator driver 186 in direction 202 causes it engage the first actuator cam 182 and the second actuator cam 184 to induce a rocking motion in the agitator drive shaft 122. In the embodiment presented, the agitator actuator 180 comprises a first cam driver 198 and a second cam driver 200 that engage the first actuator cam 182 and the second actuator cam 184. The first cam driver 198 and second cam driver 200 may be pins, with or without rollers, or other suitable structure for driving the agitator actuator 180 upon rotation of the actuator driver 186. One or more cam drivers may be provided.

A spring 188 may be connected to the replenisher housing 114 and the agitator actuator 180 in a manner such that the spring 188 biases the agitator actuator 180 in a direction 190. Rotating the actuator driver 186 causes it to engage the first actuator cam 182 and rotate the agitator actuator 180 opposite to the direction 190. Rotating the actuator driver 186 further causes it to engage the second actuator cam 184 and rotate the agitator actuator 180 in the direction 190. The spring 188 preferably causes the agitator actuator 180 to accelerate and strike a stop 208 mounted to the replenisher housing 114 upon release by the first actuator cam 182, which assists in causing toner movement through the toner passage 116. The second actuator cam 184 acts as an assist for the spring 188 in the event that the agitator actuator 180 fails to rotate in the direction 190 upon release by the first cam driver 198. Either or both of the first and second cam drivers 198 and 200 may cause the agitator actuator 180 to rotate opposite to direction 190 against the force of spring 188. Either or both of the first and second cam drivers 198 and 200 may assist in rotating the agitator actuator 180 in the direction 190.

In the embodiment presented, the agitator actuator 180 comprises an arm 192 having an arm end 194. The first actuator cam 182 is disposed on the arm end 194, and a finger 196 extends from the arm end 194, the second actuator cam 184 being disposed on the finger 196. The actuator driver 186 is a gear driven by another gear 204 which, in turn, is driven by a shaft passing through the replenisher housing 114, an electric motor, etc.

Although a specific rocking mechanism 124 is presented, it is not intended to so limit the invention since innumerable variations are possible and various rocking mechanisms are know in the mechanical arts implementing gears, cams, linkages, etc.

The toner agitator, sealing arrangement, funnel, and rocking mechanism, and the various features and aspects thereof, may be implemented alone or in combination with one or more of the others.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

We claim:

1. A toner replenisher for an electrographic imaging machine for improved toner flow, comprising:

a replenisher housing, having an inlet end and an outlet end, defining a toner passage;

an agitator drive shaft extending into the replenisher housing;

a rocking mechanism connected to the agitator drive shaft; and a toner agitator mounted to the agitator drive shaft within the toner passage, the toner agitator having a first agitator body and a second agitator body, each body having at least one finger wherein one of the fingers extends toward the inlet end and the fingers of each body are spaced apart and opposing each other.

2. The toner replenisher of claim 1, wherein the toner agitator further includes an agitator base connecting the first agitator body and the second agitator body.

3. The toner replenisher of claim 1, wherein one of the fingers extends toward the outlet end.

4. The toner replenisher of claim 1, wherein one of the first agitator body and the second agitator body has a first portion that defines a plane and at least one finger extending from the body at an angle to the plane.

5. The toner replenisher of claim 1, wherein the toner agitator further includes a third portion connecting the first agitator body and the second agitator body.

6. The toner replenisher of claim 1, wherein the toner passage includes a sloped wall and the toner agitator comprises a first portion that defines a plane, at least one of the fingers extending from the first portion and defining an axis at an angle to the plane and the angle extends the at least one of the fingers toward the sloped wall.

7. The toner replenisher of claim 1, wherein the rocking mechanism includes an agitator actuator mounted to the drive shaft wherein the agitator actuator includes a first and second actuator cam.

8. The toner replenisher of claim 7 further including a spring connected to the replenisher housing and the agitator actuator in such that the spring biases the agitator in a direction.

9. The toner replenisher of claim 1, wherein:

the toner agitator comprises a first portion that defines a plane, at least one of the fingers extending from the first portion and defining an axis at an angle to the plane; and, the toner agitator comprises a second portion that defines another plane, at least another of the fingers extending from the second portion and defining an axis at an angle to the plane.

10. The toner replenisher of claim 1, wherein the toner agitator further comprises at least one finger comprising a first finger portion extending toward the outlet end, a third finger portion extending toward the inlet end, and a second finger portion connecting the first finger portion and the third finger portion.

11. A toner replenisher method for an electrographic imaging machine for improved sealing and flow between the toner replenisher and the toner bottle, comprising:

rocking a toner agitator with a drive shaft and a spring, disposed within a replenisher housing having an inlet end and an outlet end, by rotating an agitator drive shaft extending into the replenisher housing;

simultaneously moving a plurality of toner agitator, fingers extending toward the inlet end, and enhancing the agitator movement with the spring.

12. A toner replenisher for an electrographic imaging machine for improved sealing and flow between the toner replenisher and the toner bottle, comprising:

a replenisher housing, having an inlet end, defining a toner passage;

an agitator drive shaft extending into the housing;

a toner agitator mounted to the drive shaft within the toner passage, the toner agitator having a first agitator body and a second agitator body, each body having at least one finger where the fingers of each body are spaced apart and opposing each other; and, a funnel, including one or more funnel walls, disposed at the replenisher housing inlet end and comprising an inlet mouth that matches a toner bottle mouth at a sealing face and an outlet mouth smaller than the inlet mouth.

13. The toner replenisher of 12, wherein the funnel is a separate piece placed in the replenisher housing inlet end flush with the inner surface of the inlet at the sealing face such that at least three of the funnel walls are sloped toward the inlet.

14. The toner replenisher of 12, wherein the funnel is a separate piece having a ridge on the sealing face, placed in the replenisher housing inlet end, the inlet end defining an inlet end mouth that does not match the toner bottle mouth when the ridge is not engaged.

15. The toner replenisher of 12, further having an elastomeric member spaced from and adjacent the inlet mouth.

* * * * *